US005314117A

United States Patent [19]

Pavljuk et al.

[11] Patent Number: 5,314,117

[45] Date of Patent: May 24, 1994

[54] FUEL NOZZLE GENERATING ACOUSTIC VIBRATIONS

[76] Inventors: Vitaly G. Pavljuk, ulitsa Lermontova, 14, kv. 188, Simferopol; Krarm P. Tsvetaev, ulitsa Revoljutsii, 3, kv. 3, Alupka; Jury Y. Dolgopolov, prospekt Pobedy, 48, kv. 25, Simferopol; Alexandr I. Zhukov, ulitsa Sverdlova, 75, kv. 44, Yalta, all of

[21] Appl. No.: 941,035

[22] PCT Filed: Jan. 20, 1992

[86] PCT No.: PCT/RU92/00011

§ 371 Date: Sep. 30, 1992

§ 102(e) Date: Sep. 30, 1992

[30] Foreign Application Priority Data

Jan. 18, 1991 [SU] U.S.S.R. ..... 4899373

[51] Int. Cl.[5] ..... F23D 11/10; F02M 67/00

[52] U.S. Cl. ..... 239/102.1; 239/406; 239/408; 239/417.3; 239/467; 239/500

[58] Field of Search ..... 239/102.1, 401, 403, 239/405, 406–408, 467, 498, 500, 502, 417.3

[56] References Cited

U.S. PATENT DOCUMENTS

| | | | |
|---|---|---|---|
| 3,923,248 | 12/1975 | Cresswell | 239/500 |
| 4,102,651 | 7/1978 | Kerner et al. | 239/102.1 |

FOREIGN PATENT DOCUMENTS

| | | | |
|---|---|---|---|
| 1551648 | 3/1979 | Fed. Rep. of Germany . | |
| 2420039 | 10/1979 | France . | |
| 306270 | 8/1971 | U.S.S.R. . | |
| 309206 | 9/1971 | U.S.S.R. . | |
| 787805 | 12/1980 | U.S.S.R. . | |
| 1603138 | 10/1990 | U.S.S.R. | 239/102.1 |

*Primary Examiner*—Karen B. Merritt
*Attorney, Agent, or Firm*—Ladas & Parry

[57] ABSTRACT

A fuel nozzle comprises a body (1) with a cylindrical sleeve (2) accommodating a tubular element (3) having an axially extending channel (16). At the end of the element (3) there is arranged an acoustic head (5) having a conically shaped surface (6) adapted to generate acoustic vibrations. An annular recess (12) is formed on the surface (6). The nozzle body (1) carries a reflecting surface (9) formed as a plurality of pyramids. The fuel nozzle is provided with a device (18) adapted to swirl the gas flow and a regulating element (17) accommodated in the axial channel (16).

4 Claims, 1 Drawing Sheet

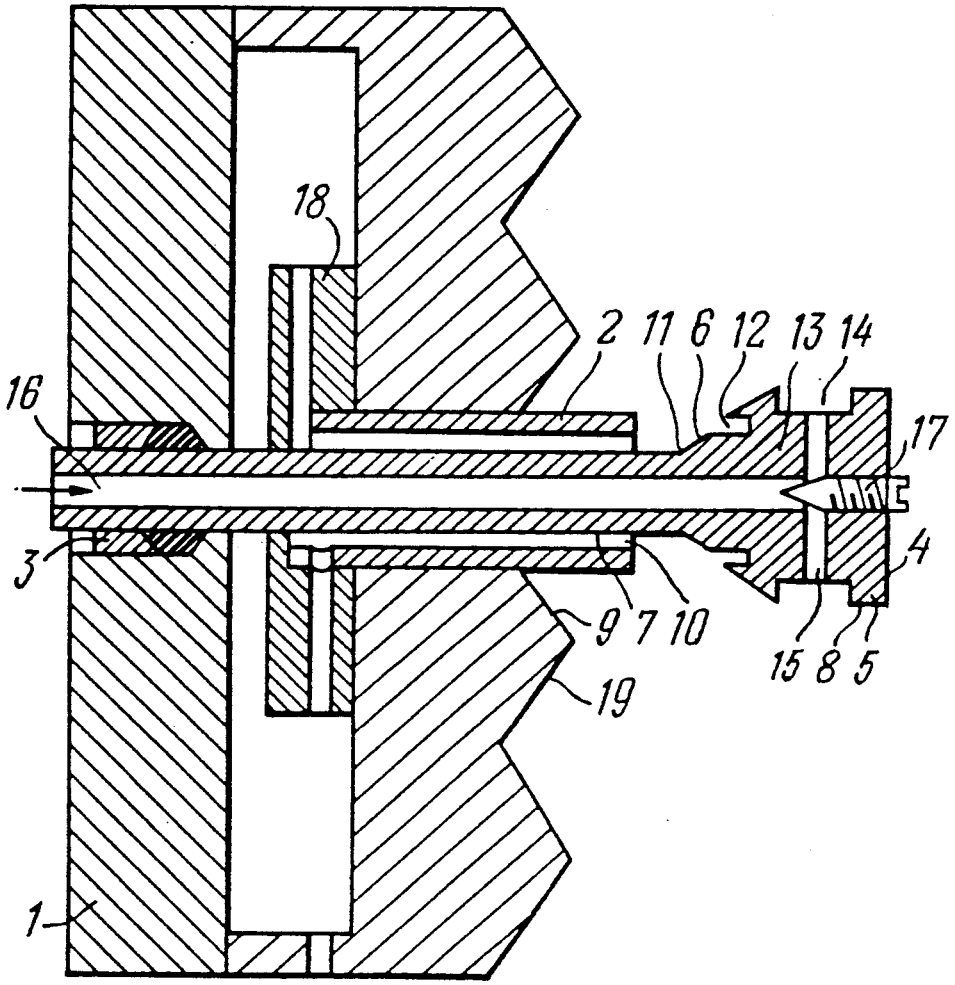
18
2
11
6
12
13
14
16
17
3
4
9
7
10
15
8
5
19
1

FUEL NOZZLE GENERATING ACOUSTIC VIBRATIONS

FIELD OF THE INVENTION

The present invention relates to devices for atomizing fuel and, more specifically, to fuel-injection nozzles.

The present invention may be advantageously used in the automotive, petroleum refining, food and other industries.

PRIOR ART

There is known in the prior art a fuel-injection nozzle (Ref. W. A. Wanscheidt et al. DIESEL ENGINES, 1977, Machinostroyeniye/Mechanical Engineering-/Publishers, Moscow) comprising a body, conduits for supply and removal of fuel, and a fuel-atomizing nozzle. The prior-art device does not ensure good quality of fuel atomization.

Also known in the prior art is a fuel-injection nozzle (Ref. SU, A, 731190), comprising a body, a fuel-supply pipe, in which, upstream of radial openings arranged in one and the same plane, a constricted portion is provided in the form of an axial conical nozzle. This prior-art nozzle further comprises a resonator whose tail end is shaped as a conical splitter having its apex directed towards the nozzle, and adjoining the radial openings. The generatrix of the conical splitter is arcuate, while its annular slot is formed as a Delaval nozzle.

In the prior-art fuel nozzle, dispersion of fuel takes place in three steps, namely: in radial openings, in the super-critical region of the annular slot, and between the resonator and the bevelled end of the annular slot. This structural arrangement makes it possible to improve completeness of fuel combustion. However, ultimately, this arrangement does not improve the quality of fuel atomization and ensure required fuel distribution throughout a fuel combustion chamber.

SUMMARY OF THE INVENTION

The present invention seeks to solve the problem of developing a fuel-injection nozzle whose structural arrangement is such as to make possible a uniform distribution of fuel both in terms of pressure and volume and to improve fuel atomization efficiency, whereby it becomes possible to lower fuel supply pressure and, consequently, to increase the engine efficiency.

The above-formulated problem is solved by providing a fuel-injection nozzle comprising a body and a cylindrical sleeve accomodating a tubular element provided with an axially extending channel, at the end of which an acoustic head is arranged having a surface capable of generating acoustic vibrations. The nozzle body supports a reflecting surface. The tubular element is disposed perpendicularly to the reflecting surface and forms an annular channel between the internal surface of the sleeve and the external surface of the element. The surface of the acoustic head is provided with radial recesses communicating with the axially extending channel. In accordance with the present invention, the nozzle is provided with a device which is intended to swirl the gas flow and which is attached to the nozzle body. The axial channel of the nozzle accomodates a regulating element, while the surface generating acoustic vibrations is conically shaped and has an annular recess. The reflecting surface of the nozzle is made in the form of a plurality of pyramids whose lateral faces are conjugated at the base of the sleeve with its cylindrical surface.

The above-described structural arrangement of the nozzle enables the gas flow to be swirled about its axis and then to be reflected first from the conical surface and next from the reflecting surface. The thus-reflected toroidally shaped vortex atomizes fuel droplets to minute particles and causes them to be uniformly distributed throughout the entire volume of the chamber, the droplet size in the fuel mixture being regulated by the element mounted in the axial channel.

It is advisable that the surface of the acoustic head be provided with an annular bore communicating with the radial openings, and this arrangement is conducive to intensive mixing of the gas vortex with minute fuel droplets.

It is advisable that the apex of the surface generating acoustic vibrations face the reflecting surface. This arrangement of the reflecting surface contributes to intensive flow-around of the surface by gas streams.

Optionally, it is also possible for the magnitude of the angle between the faces of the pyramids forming the reflecting surface be equal to at least 110°, this angle being preferably, since the fuel atomization efficiency is thereby considerably improved.

BRIEF DESCRIPTION OF THE DRAWINGS

In what follows, the invention will be explained by the detailed description of a specific embodiment of its realization, with references to the appended drawing the sole figure of which is a longitudinal sectional view of the nozzle of the invention.

DETAILED DESCRIPTION OF ONE EMBODIMENT OF THE INVENTION

The fuel-injection nozzle comprises a body 1 and a cylindrical sleeve 2 accomodating a tubular element 3, at the end 4 of which an acoustic head 5 having a conically shaped surface 6 is arranged. The surface 6 is adapted to generate acoustic vibrations and is conjugated with the cylindrical surfaces 7 and 8 of the tubular element 3, the cylindrical surfaces 7 and 8 being disposed on either side of the conical surface 6. The nozzle body 1 provides a reflecting surface 9. The tubular element 3 is arranged perpendicularly to the reflecting surface 9, thereby forming an annular gas channel 10 between the internal surface of the sleeve 2 and the external surface of the tubular element 3. The apex 11 of the conical surface 6 is directed towards the reflecting surface 9. In the conical surface 6 there is formed an annular recess 12 for a resonator 13, while the cylindrical surface 8 of the acoustic head 5 is provided with an annular bore 14 and with radial channels 15 communicating with a fuel supply channel 16 of the tubular element 3 which accomodates a regulating element 17. The inlet of the annular gas channel 10 is connected to a device 18 adapted to swirl the gas flow. The reflecting surface 9 is formed as a plurality of pyramids whose faces 19 are conjugated at the sleeve 2 base with its cylindrical surface. The magnitude of the angle between the faces of the pyramids constituting the reflecting surface 9 is equal to at least 110°, while the pressure difference in the cavities of the annular gas channel 10 upstream of the nozzle and at its outlet is equal to at least 2.5 atm.

The fuel nozzle having the structural arrangement in accordance with the invention is operated as follows:

Fuel supplied by a fuel delivery system (not shown in the drawing) is admitted to the nozzle. Gas (for instance, compressed air from a compressor or a gas bottle which are not shown) is supplied through the gas channel 10 to the nozzle. A constant gas pressure difference equal to 2.5 atm between the nozzle inlet and outlet is maintained by means of a pressure regulator (not shown in the drawing) owing to its being communicated with the fuel-atomization cavity. The gas delivered to the annular gas channel 10 through the gas flow-swirling device 18, upon leaving the channel, is swirled about its axis. The gas is then reflected first from the conically shaped surface 6 having, formed therein, the recess 12 of the resonator 13, and—next—from the reflecting surface 9 of the nozzle body 1, whereupon the reflected gas flow flows around the conical surface 6 and the cylindrical surface of the acoustic head 5. Upon passing the annular bore 14 and the radial channels 15 formed in the surface of the acoustic head 5 and communicated with the axial fuel supply channel 16, the reflected toroidally shaped vortex atomizes fuel droplets into minute particles, and is intensively mixed with them to form thereby a homogeneous mixture uniformly distributed all over the volume of the system, the droplet size in the fuel mixture being adjustable by the element 17, such as, e.g. a screw, provided in the channel 16.

INDUSTRIAL APPLICABILITY

The present invention may be used to best advantage for separating crude petroleum to fractions, for contactless bulk polishing of articles, for disinfecting an ambient environment, and for separating hydrogen sulphide into its constituents.

We claim:

1. A nozzle comprising a body (1) with a cylindrical sleeve (2) accommodating a tubular element (3) having an axially extending channel (16), at an end of which an acoustic head (5) is arranged with a surface (6) for generating acoustic vibrations; the nozzle body (1) supporting a reflecting surface (9); said tubular element (3) being arranged perpendicularly to said reflecting surface (9) so as to form an annular channel (10) between the internal surface of the sleeve (2) and the external surface of the tubular element (3); a radial channel (15) being formed in said acoustic head (5) and being in communication with said axial channel (16), characterized in that the nozzle is further provided with a device (18) associated with the nozzle body (1) for supplying a gas flow thereto, and a regulating element (17) arranged in said axial channel (16) in said tubular element; said surface (6) of said acoustic head being conically shaped and extending to an annular recess (12) provided in said acoustic head for generating acoustic vibrations; said reflecting surface (9) comprising a plurality of pyramids having lateral faces (19) joined to an outer cylindrical surface of the sleeve (2).

2. A nozzle as claimed in claim 1, characterized in that said acoustic head (5) has an outer surface provided with an annular bore (14) connected to said radial channel (15).

3. A nozzle as claimed in claim 1, characterized in that said conical surface (6) of said acoustic head tapers towards said reflecting surface (9).

4. A nozzle as claimed in claim 1, characterized in that the lateral faces of the pyramids (19) of the reflecting surface (9) form an angle which is equal to at least 110°.

* * * * *